United States Patent [19]

Fish

[11] Patent Number: 4,679,541

[45] Date of Patent: Jul. 14, 1987

[54] BELT-CONFIGURED SAW FOR CUTTING SLOTS INTO STONE

[75] Inventor: Donald D. Fish, Bedford, Ind.

[73] Assignee: W. F. Meyers Company, Inc., Bedford, Ind.

[21] Appl. No.: 754,675

[22] Filed: Jul. 12, 1985

Related U.S. Application Data

[63] Continuation-in-part of Ser. No. 657,833, Oct. 5, 1984, Pat. No. 4,603,678.

[51] Int. Cl.[4] ..... B28D 1/08

[52] U.S. Cl. ..... 125/21; 51/357

[58] Field of Search ..... 125/21, 18; 51/395, 51/399, 136, 397, 398, 357; 299/35, 36

[56] References Cited

U.S. PATENT DOCUMENTS

| | | | |
|---|---|---|---|
| 2,059,583 | 11/1936 | Jackson | 51/397 |
| 3,534,508 | 10/1970 | Vecchio | 51/399 |
| 4,181,115 | 1/1980 | Weisner | 125/21 |
| 4,384,564 | 5/1983 | Smith | 125/21 |

FOREIGN PATENT DOCUMENTS

| | | | |
|---|---|---|---|
| 14776 | 9/1980 | European Pat. Off. | 125/21 |
| 70506 | 1/1983 | European Pat. Off. | 299/35 |
| 2107454 | 8/1972 | Fed. Rep. of Germany | 51/399 |
| 527732 | 10/1921 | France | 51/136 |
| 1113453 | 3/1956 | France | 51/136 |
| 815631 | 7/1959 | United Kingdom | 125/21 |

*Primary Examiner*—Harold D. Whitehead

*Attorney, Agent, or Firm*—Woodard, Weikart, Emhardt & Naughton

[57] ABSTRACT

A stone cutting device including a continuous flexible cutting belt for cutting a slot in stone which is in the round. The device includes a main frame, a jib pivotally mounted to the main frame, aligned sheaves rotatably mounted to the main frame and jib, a continuous flexible cutting belt extending around and in driven engagement by the sheaves, and a means to rotate at least one of the sheaves. The continuous flexible cutting belt includes a plurality of spaced apart abrasive cutting elements extending across the top and sides of the belt. The cutting elements are flush with the remainder of the top and side surfaces of the belt which includes a molded-in-place resilient material. Belt strength is provided by a flexible cable extending through the length of the belt. The preferred embodiment of the invention includes a groove on the top and bottom edges of the jib and outlet means opening in the groove allowing water to be emitted between the groove and the belt to provide lubrication and reduced vibration as the belt passes through the groove. During operation, the water thus emitted from the jib passes outside the groove and into the cut slot in the stone and washes away stone cuttings for improved operation of the device.

5 Claims, 15 Drawing Figures

BELT-CONFIGURED SAW FOR CUTTING SLOTS INTO STONE

BACKGROUND OF THE INVENTION

Reference to Related Application

This is a continuation-in-part of my copending U.S. patent application entitled BELT-CONFIGURED SAW FOR CUTTING SLOTS INTO STONE, filed on Oct. 5, 1984 as Ser. No. 657,833, now U.S. Pat. No. 4,603,678.

1. Field of the Invention

This invention relates in general to stone cutting devices and in particular to such a device having a flexible and continuous stone cutting belt.

2. Description of the Prior Art

For the purposes of removing hard natural stone from quarries and further processing it, means for cutting stone have been developed and improved on over the years. Various wire saws have been designed to cut stone after it is removed from the ground. For example, the U.S. Pat. No. 3,598,101 issued to Hensley describes a continuous wire saw with cutting elements attached. In U.S. Pat. No. 3,884,212, I disclosed an improved wire saw comprising abrasive cutting elements sleeved over on endless flexible wire and a pressure molded-in-place resilient material surrounding the cable and providing a substantially uniform diameter for the endless saw. This saw is commonly used in stationary wire saw stands wherein the wire saw is engaged by two sheaves located on either side of the block of stone being sawed. My patented wire saw is also adpatable for cutting stone which is still in the ground. In this application, holes must first be drilled in the stone through which the wire saw is threaded and then reattached and drivingly engaged by a single pulley. Despite the ability to use my wire saw in a quarry application, it is desirable to have a continuous running device for cutting stone in the ground which does not require the tasks ot drilling holes and threading and reattaching a wire saw.

Other methods and devices for removing stone from the ground are currently in use. It is known to drill holes in stone and then wedge large pieces of stone out with mechanical means employing hydraulics and pneumatics. This method is difficult, time consuming and does not result in a smooth, cut surface on the stone. A device is known to be used in Europe which includes a jib pivotally mounted to a vehicle, having aligned sprockets and a guide bar to drive a continuous chain on which diamond cutting bits are attached for cutting stone. The jib travels through the stone as it is cut away by the chain saw. Several problems are associated with using this chain-type saw. The chain is heavy, expensive and must be run at slow speeds because of its mechanical construction. The chain also causes vibration during operation and wears out easily. Should the chain break during operation. it may perilously fly off the jib. Furthermore, necessary lubrication of the chain requires the use of expensive grease which is somewhat incompatable with the use of water to wash away stone cuttings.

It is desired to have a smooth operating inexpensive, jib-type stone cutting device for use in quarries, capable of operating without expensive lubrication and capable of washing away stone cuttings.

While improvements in the wire saw have resulted in less expensive, smoother, faster and safer operation of stationary wire saw devices, these advantages have not been heretofore available in the quarry application where a jib is used. The invention disclosed herein is addressed to overcoming this problem.

SUMMARY OF THE INVENTION

One embodiment of the present invention is a device for cutting a slot in stone comprising a main frame, a jib movably mounted to the main frame, a pair of spaced apart and aligned sheaves with at least one of the sheaves having lateral width and being mounted to the jib, a means on the frame connected to and being operable to rotate at least one of the sheaves, and a contnuous flexible belt with a top and opposite sides and extending around and in driven engagement by the sheaves, including a plurality of spaced apart abrasive cutting strips extending across the top and sides of the belt which are flush with the belt, said sides defining the width of the belt which is sized at least equal to the lateral width of the sheave on the jib, enabling the sheave to pass through a slot cut by the belt as the jib moves the belt through the slot.

Another embodiment of the present invention is a device for cutting a slot in stone comprising a main frame, a jib movably mounted to the frame, the jib having a groove and including water outlet means opening in the groove, a pair of spaced apart and aligned sheaves being rotatably mounted and with at least one of the sheaves having lateral width and being mounted to the jib means on the frame and operably associated with the sheaves being operable to rotate same, a continuous flexible belt extending through the groove with a top and opposite sides and extending around and in driven engagement by the sheaves, the sides defining the width of the belt which is sized at least equal to the lateral width allowing the one sheave to pass through a slot cut by the belt as the jib moves the belt through the slot, water means on the jib and in communication with the water outlet means and being operable to emit water between the groove and the belt to provide luhrication therebetween.

One object of the present invention is to provide an improved stone cutting device employing a stone cutting belt.

Another object of the present invention is to provide a device for cutting stone which is in the ground.

Yet another object of the present invention is to provide a device for high speed cutting of a slot in stone, which is in the ground.

It is a further object of the present invention to provide a device for cutting stone which is in the ground, where the cutting elements are protected by adjacent resilient material.

Another object of the present invention is to provide a belt-configured device for cutting stone which is in the ground.

Yet another object of the present invention is to provide a device for cuttings stone with means for lubricating and eliminating wear on a driven stone cutting belt.

A further object of the present invention is to provide a stone cutting device which includes a fluid means for supporting the cutting device.

It is a further object of the present invention to provide a device for cutting stone having vibration free cutting action.

Another object of the present invention is to provide a belt-configured device for cutting stone having cutting elements securely anchored in the belt.

Related objects and advantages of the present invention will be apparent from the following description.

DESCRIPTION OF THE PREFERRED EMBODIMENTS

Figure 1:
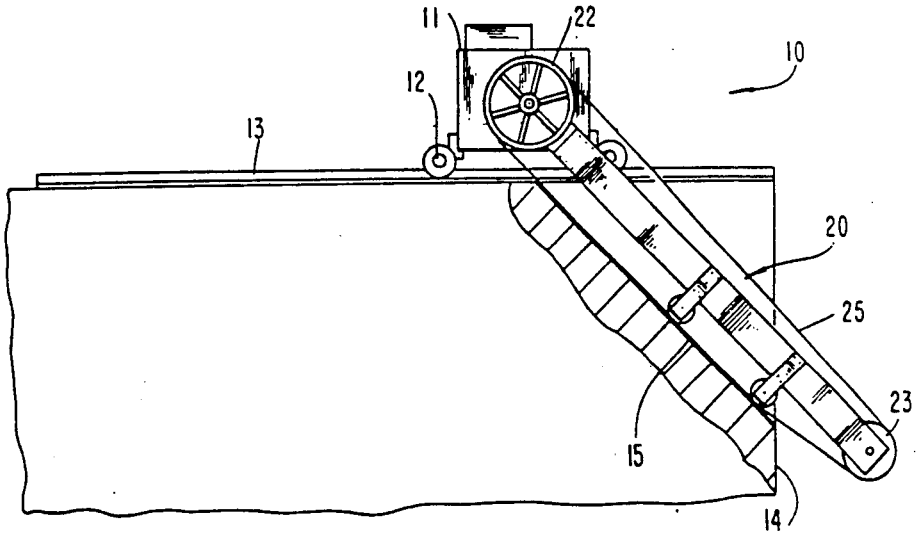
FIG. 1 is a fragmentary side view of a device cutting a slot in stone according to an alternate embodiment of the present invention.
Figure 2:
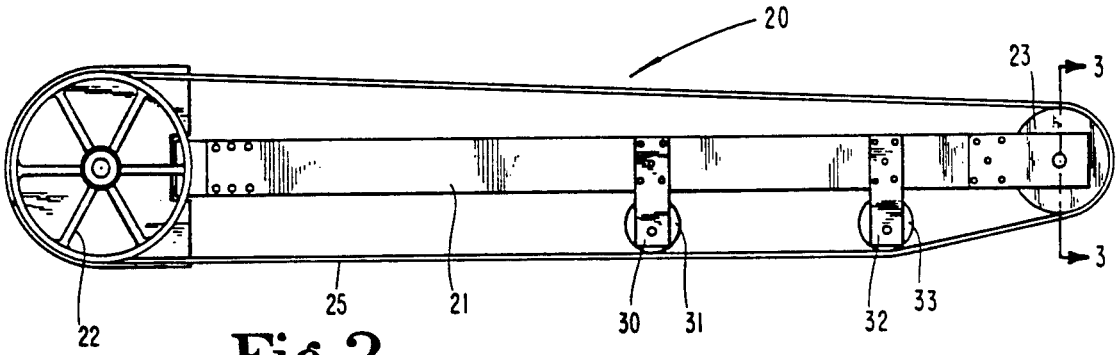
FIG. 2 is an enlarged side view of the jib comprising a portion of the FIG. 1 stone cutting device in an alternative embodiment of the present invention.

For the purposes of promoting an understanding of the principles of the invention reference will now be made to the embodiments illustrated in the drawings and specific language will be used to describe the same. It will nevertheless be understood that no limitation of the scope of the invention is thereby intended such alterations and further modifications in the illustrated device and such further applications of the principles of the invention as illustrated therein being contemplated as would normally occur to one skilled in the art to which the invention relates.

Referring now more particularly to FIG. 1 for an alternative embodiment of the present invention, there is shown a device 10 for cutting a slot 15 in stone 14 located in the ground. Device 10 includes a vehicle 11 movably mounted atop a pair of conventional rails 13. Vehicle 11 includes four wheels 12 rotatably mounted to the bottom end of the vehicle frame with a pair of wheels located on one side of the vehicle engaging one of the rails and with the second pair of wheels mounted to the opposite side of the vehicle engaging the second rail. A braking means is used in the present embodiment of device 10 to prevent relative motion between vehicle 11 and rails 13 during operation.

Vehicle 11 includes a jib 20 pivotally mounted to the main frame of the vehicle with jib 20 including a pair of sheaves 22 and 23 rotatably mounted to the opposite ends of the jib. Sheaves 22 and 23 are spaced apart and are aligned. Jib 20 includes an elongated member 21 with the opposite ends thereof having sheaves 22 and 23 rotatably mounted in a conventional fashion. A pair of downwardly extending legs 30 and 32 are fixedly mounted to elongated member 21. A pair of idler sheaves 31 and 33 are rotatably mounted in a conventional manner to the bottom end of legs 30 and 32. Belt saw 25 extends in continuous fashion around sheaves 22 and 23 and immediately adjacent and in contact with idler sheaves 31 and 33.

Vehicle 11 includes a shaft 30 rotatably mounted thereto and extending through the opposite sides of the vehicle. One end of shaft 30 includes a pulley wheel 31 fixedly secured thereto in driven engagement with V-belt 32 in turn extending around and driven by a pulley wheel 33 mounted to the output shaft of a conventional motor 39 mounted to tbe vehicle. The opposite end of shaft 30 has sheave 22 fixedly secured thereto which is in driving engagement with belt 25. Thus, operation of motor 39 causes rotation of shaft 30 and movement of belt 25.

Flange 34 is pivotally mounted by conventional bearings to vehicle 11 about the axis of rotation of shaft 30. Elongated member 21 is fixedly secured to flange 34 on one side of shaft 30 whereas a plurality of gear teeth 35 are fixedly mounted to flange 34 on the opposite side of shaft 30. Teeth 35 are in meshing engagement with a conventional worm gear 36 in turn rotated by a hand crank 37. A conventional gear box 38 is positioned between hand crank 37 and worm gear 36. The operator may therefore rotate hand crank 37 causing rotation of worm gear 36 and thus pivotal motion of the elongated member 21 and the jib about the axis of rotation of shaft 30.

Figure 8:
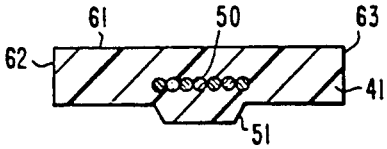
FIG. 8 is a cross-sectional view of the cutting belt of FIG. 6 taken along line 8—8 of FIG. 6 and viewed in the direction of the arrows.
Figure 9:
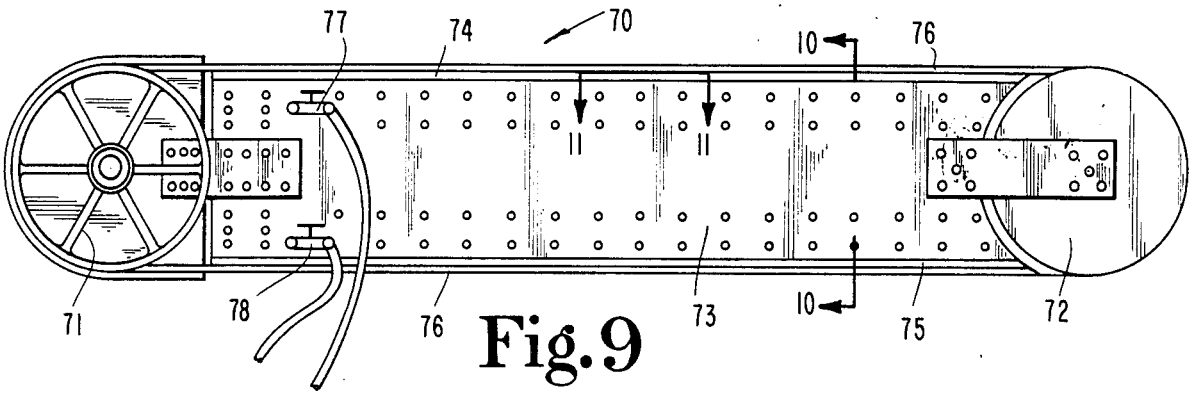
FIG. 9 is an enlarged side view of the jib comprising a portion of the FIG. 1 stone cutting device in the preferred embodiment of the present invention.

Saw belt 25 is a continuous flexible belt which extends around and is in driven engagement by the aligned sheaves 22 and 23. Belt 25 includes a continuous flexible main body 41 which is produced from polyurethane or other suitable plastic or flexible material. The main body 41 of the belt includes a wire cable 50 which extends through the length of the belt main body to increase the strength thereof. As shown in FIG. 8, the cable is arranged in a plurality of rows which extend at least partially across the width of the belt main body. In the preferred embodiment, the belt includes a single cable which extends multiple times around the length of the belt thereby forming the multiple rows. Alternatively, a plurality of wire cables may be arranged in side-by-side fashion with each cable extending through the length of the belt.

Figure 3:
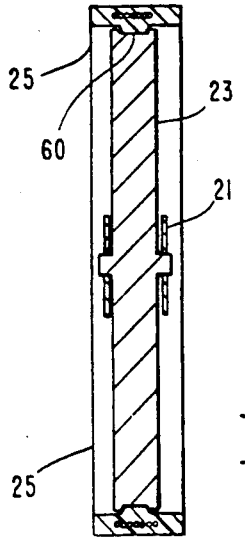
FIG. 3 is an enlarged cross-sectional view of a portion of the jib shown in FIG. 2 taken along line 3—3 in FIG. 2 and viewed in the direction of the arrows, particularly showing the lateral width of the sheave and member holding the sheave, in relation to the width of the cutting belt.
Figure 4:
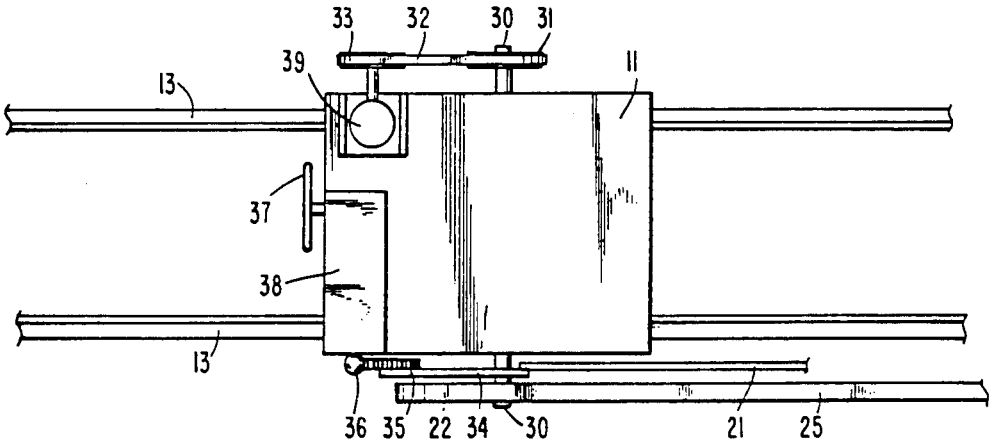
FIG. 4 is a fragmentary enlarged top view of the device shown in FIG. 1.
Figure 5:
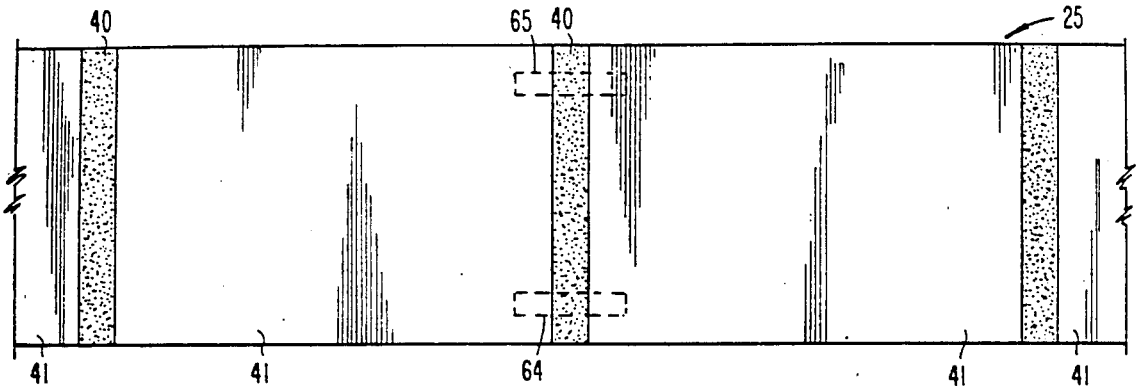
FIG. 5 is a top view of a portion of a cutting belt having C-shaped cutting strips.

The bottom end 51 of the belt main body is configured as a truncated V-shaped projection extending complementarily into the outer circumference 60 (FIG. 3) of each sheave 22, 23, 31 and 33 thereby enabling sheave 22 to drivingly engage the belt. The top surface 61 of the belt main body is flat and is arranged perpendicularly relative to the flat sides 62 and 63 of the belt.

Belt 25 includes a plurality of spaced apart abrasive cutting strips 40 which extend across the top and sides of the belt and are flush therewith. Abrasive cutting strip 40 (FIG. 7) includes a top flat surface 44 arranged perpendicularly relative to the opposite flat sides 43 of the strip. Each strip 40 may be produced from a powdered metal mix such as bronze having diamonds of a size of U.S. 16–20 mesh positioned uniformly throughout. The powdered metal and bronze is inserted into a resistance sintering press and heated to 1800° F. Such a press is available from Dr. Fitch GmbH, Stuttgart Germany.

The main body 41 of the belt is produced by initially tensioning cable 50 at approximately 1,000 pounds tension and then coating the cable with a primer to cause plastic to adhere thereto. The abrasive cutting strips are then placed in an injection mold with the mold being at approximately 150° F. Polyurethane is then ejected into the mold to encapsulate the cable. The encapsulated belt is then cured at 280° F. In one embodiment, approximately seven and one-half feet of belt was produced in a mold at a time. The top surface 44 of the abrasive cutting strip is positioned flush with the top surface 61 of the main body 41. Likewise the opposite sides 43 of the abrasive cutting strip are flush with the opposite sides 62 and 63 of the main body. As the belt is moved across stone 14 to cut slot 15 therein, the plastic main body of the belt positioned between the abrasive cutting strips 40 wears so that the top surface and side surfaces of the plastic are located approximately 0.015 inches below the top and side surfaces of the abrasive cutting strips. Thus, the abrasive cutting strips are protected from snagging on external objects and likewise vibration problems are minimized. Best results have been obtained by operating device 10 at belt speeds of between 3000 and 6000 feet per minute.

Figure 6:
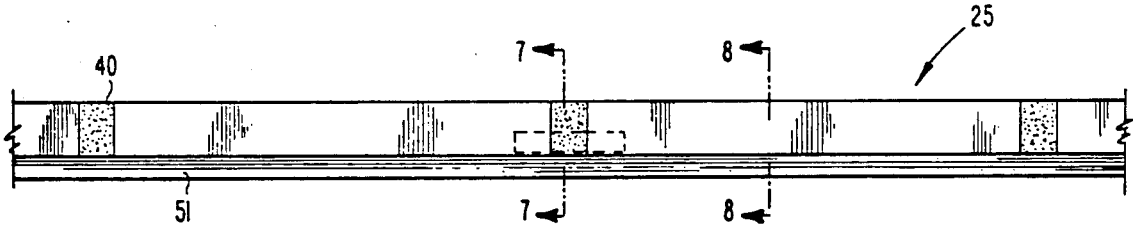
FIG. 6 is a side view of the cutting belt of FIG. 5.
Figure 7:
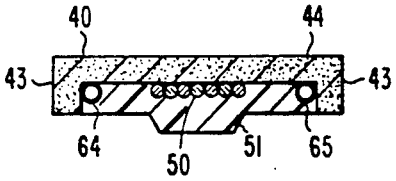
FIG. 7 is a cross-sectional view of the cutting belt of FIG. 6. taken along line 7—7 in FIG. 6 and viewed in the direction of the arrows, particularly showing the shape of the cutting strip and the positioning of the anchoring dowel pins attached thereto.

Each cutting strip is anchored to the main body by a pair of hollow dowel pins 64 and 65 which are silver soldered to each abrasive strip. The bottom side of each strip 40 is indented as shown in FIG. 7 to allow cable 50 to extend therethrough. The cable is not actually affixed to the cutting strip but is merely positioned adjacent thereto. The hollow dowel pins 64 and 65 have lengths sufficient to extend outwardly of each cutting strip such as shown in FIG. 6 and into the adjacent portion of the plastic main body thereby anchoring the abrasive cutting strip to the belt main body.

The preferred embodiment of the invention is shown in FIGS. 9–15. The preferred embodiment of the present invention is a device for cutting a slot in stone located in the ground including a vehicle atop rails as previously described. The vehicle includes a jib 70 shown in FIG. 9 pivotally mounted to the main frame of the vehicle with jib 70 including a pair of sheaves 71 and 72 rotatably mounted to the opposite ends of the jib. Sheaves 71 and 72 are spaced apart and are aligned. By making sheaves 71 and 72 of equal diameter, flexing of cutting belt 76 is uniform during operation, thereby extending belt life. Jib 70 includes an elongated main body 73 with the opposite ends thereof having sheaves 71 and 72 rotatably mounted in a conventional fashion. The end of the main body 73 which remains above ground and higher during operation of the device includes conventional adjustable water inlet valves 77 and 78. In one embodiment, inlet valves 77 and 78 are ¾ inch pipe with conventional adjustable valves. Groove members 74 and 75 are mounted to the top and bottom edges of main body 73 in a conventional manner. Belt 76 extends in continuous fashion around sheaves 71 and 72 and immediately adjacent and in contact with groove members 74 and 75. The operation of the vehicle pivoting of the jib and movement of the belt during operation of the preferred embodiment of the stone cutting device has been previously described for the alternative embodiment and applies equally to the preferred embodiment of the invention. Further, the embodiment shown in FIGS. 9 through 15 is identical to that described for the embodiment of FIGS. 1 through 8 with the exception of the design of the jib 70 and the belt mounted thereon. Thus, the description of the vehicle or the structure for the mounting of the jib to the vehicle will not be repeated.

Figure 10:
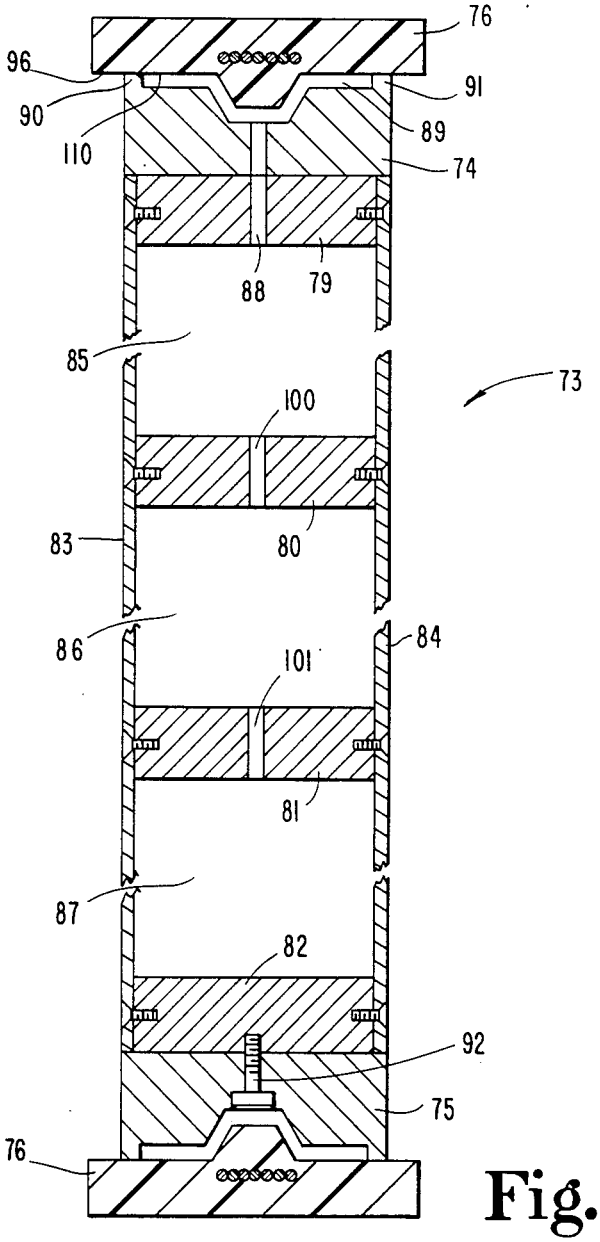
FIG. 10 is a fragmentary enlarged cross-sectional view of a portion of the jib shown in FIG. 9 taken along line 10—10 in FIG. 9 and viewed in the direction of the arrows. particularly showing the spacers and cavities between the sides of the jib.
Figure 11:
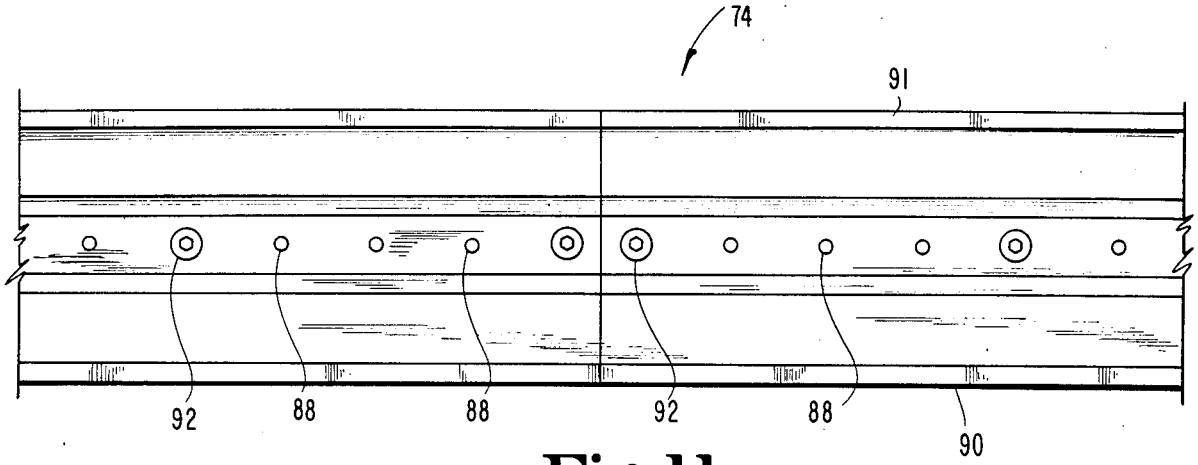
FIG. 11 is a fragmentary enlarged top view of a portion of the jib shown in FIG. 9 and viewed in the direction of arrows 11—11, particular showing the groove on the outside edge of the jib and the water outlet means opening in the groove.
Figure 12:
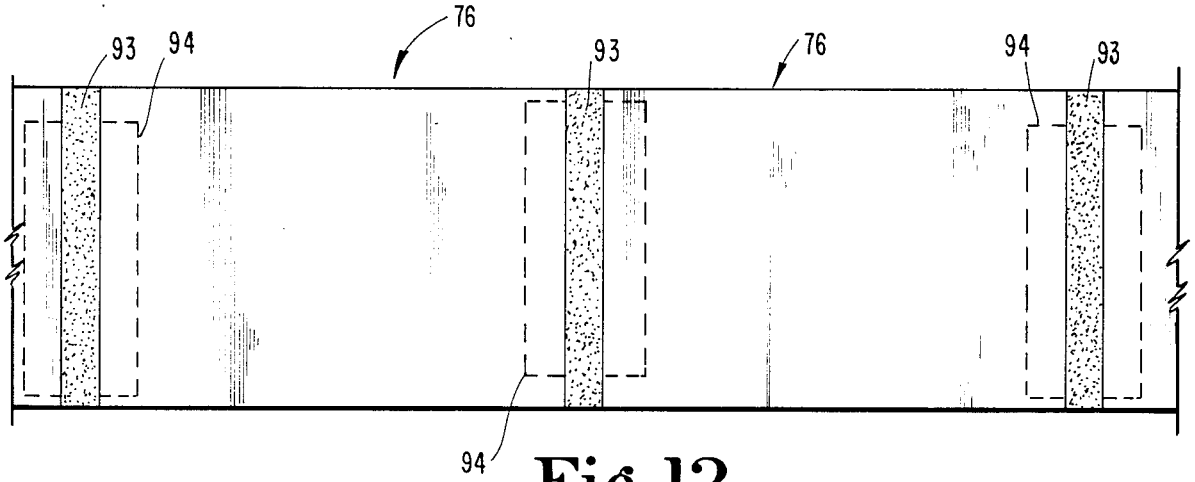
FIG. 12 is a top view of a portion of a cutting belt having alternately oriented L-shaped cutting strips.

Referring now more particularly to FIG. 10 for a description of the construction of main body 73 and groove members 74 and 75. Main body 73 includes side plates 83 and 84 spaced apart and attached by fastening devices, such as bolts, to rectangular spacers 79–82 which extend the length of main body 73. In the preferred embodiment, side plates 83 and 84 are 3/16 inch aluminum. Between spacers 79–82 are cavities 85–87. The cavities are defined by the spacers 79–82 which extend the length of main body 73 and the spacers located at each end. Water inlet means 77 and 78 open respectively into cavities 85 and 87. In the preferred embodiment, water is allowed to pass freely between cavities 85, 86 and 87 through passageways 100 and 101 provided at various locations through and along spacers 80 and 81. The proximal end of main body 73 pivotally mounted to the vehicle as well as the distal end of main body 73 are capped by the spacers to prevent the water within the cavities from escaping exoept at locations between the belt and grooved members 74 and 75.

Groove members 74 and 75 are attached by conventional means respectively to spacers 79 and 82. In the preferred embodiment, typically a screw 92 is countersunk into groove member 75 to hold groove member 75 to spacer 82. Similiar screws hold groove member 74 to spacer 79. Communication of the water which fills cavities 85–87 during operation is provided to space 89 between belt 76 and groove member 74 through passageway 88. Passageway 88 is accomplished by aligning holes drilled in spacer 79 and groove member 74. Passageway 88 is typical of multiple passageways spaced 12 inches apart in the preferred embodiment. The diameter of the passageways in the preferred embodiment is ⅛ inch. In the preferred embodiment, space 89 varies from 0.030 inches thickness at the bottom most part adjacent to passageway 88 to 0.015 inches thickness at the upper levels adjacent surface 110 of the belt. A space identical to space 89 exists between the belt and the bottom groove member 75 such as shown in FIG. 10.

Water emitted into space 89 is partially maintained in space 89 during operation of the device because of the sealing action which is caused by projections 90 and 91 of the grooved members as they support belt 76 on underside 96. During operation, the water provided under pressure by water inlet means 77 and 78 travels through and between cavities 85–87 and is emitted ar groove members 74 and 75 through passageway 88 (FIG. 11) into space 89. Some of the water is maintained in space 89 while some water escapes where the bottom surface 96 of belt 76 is supported by projections 90 and 91 of groove members 74 and 75. This thin layer of escaping water provides lubrication to the moving belt by virtue of a hydroplaning effect. Additionally, the water maintained in space 89 because of projections 90 and 91 aids in starting the belt into motion initially.

Figure 13:
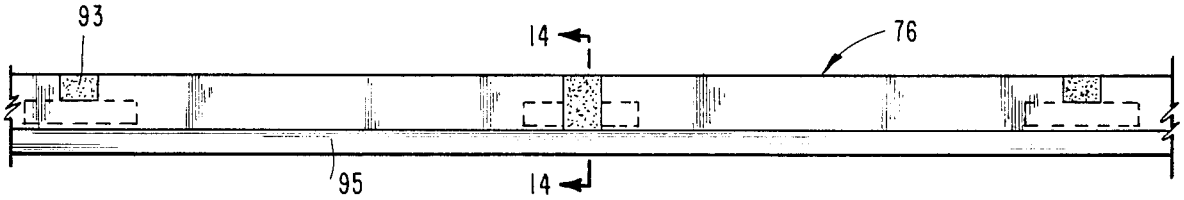
FIG. 13 is a side view of the cutting belt of FIG. 12.
Figure 14:
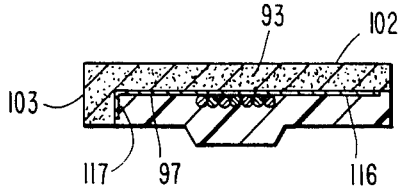
FIG. 14 is a cross-sectional view of the cutting belt of FIG. 13, taken along line 14—14 in FIG. 13 and viewed in the direction of the arrows, particularly showing the shape of the cutting strip and the positioning of the anchoring plate attached thereto.
Figure 15:
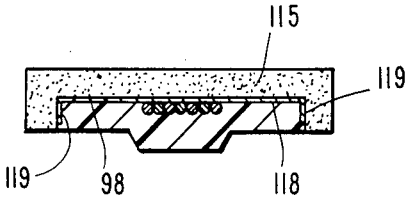
FIG. 15 is a cross-sectional view of the cutting belt taken through a cutting strip, particularly showing an alternative design for the shape of the cutting strip and also showing the position of anchoring plate attached thereto.

The construction and method of manufacturing belt 76 has been previously described in the alternative embodiment of the present invention. In the preferred embodiment, belt 76 includes a plurality of spaced apart abrasive cutting strips 93 which extend completely across the top and completely across one side in the version shown in FIGS. 12 through 14 thereby having an L-shape configuration and being flush with the belt. That is, top surface 102 and side surface 103 are flush with the main body of the belt. Top flat surface 102 is arranged perpendicular to the side surface 103. Each strip 93 may be produced as previously described. The plurality of L-shaped abrasive cutting strips 93 are arranged in alternative orientation along the belt so that the side of the cutting strip which extends down the side of the belt alternates from one side of the belt to the other along the length of the belt as shown in FIG. 13. Abrasive strip 115 (FIG. 15) is identical with strip 92 with the exception that strip 115 also extends down the opposite side of the belt thereby having a C-shape.

Abrasive cutting strip 93 is anchored to the main body of the belt by an L-shaped plate which is silver soldered to each abrasive strip. As shown in FIGS. 11–14, the L-Shaped plate 97 extends beneath the cutting strip but above the wire cable extending the length of the belt. Thus, plate 97 includes a horizontal portion 116 positioned between the cutting strip and the wire cables and a vertical portion 117 extending between the vertical portion of the cutting strip and the recessed side of the belt. The plate 98 identical to plate 97 is silver soldered to cutting strip 115 but has a C-shape in lieu of the L-shape of strip 97. Thus plate 98 includes a horizontal portion 118 located between the cutting strip 115 and the wire cables and two downwardly extending legs portions 119 located between the cutting strip and the sides of the belt.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A device for cutting a slot in stone comprising:

a main frame;

a jib movably mounted to said frame, said jib having a groove surface defining a groove and including water outlet means opening in said groove, said jib including a pair of spaced apart extensions on opposite sides of said groove extending the length of said groove;

a pair of spaced apart and aligned sheaves being rotatably mounted and with at least one of said sheaves having lateral width and being mounted to said jib;

means on said frame and operably associated with said sheaves being operable to rotate same;

a flexible belt extending through said groove with a top and opposite sides and extending around and in driven engagement by said sheaves, said sides defining the width of said belt which is sized at least equal to said lateral width allowing said one sheave to pass through a slot cut by said belt as said jib moves said belt through said slot, said belt having a continuous bottom projection facing inwardly into said groove being spaced from said groove surface along the length of said groove by water flowing outwardly from said water outlet means, said groove is complementary in shape to said projection positioned therein, said belt further having a pair of inwardly facing edge surfaces spaced apart by said projection; and, water means on said jib and in communication with said water outlet means and being operable to emit water between said groove and said projection on said belt to provide lubrication therebetween, said extensions forming limit means mounted on said jib and extending adjacent said belt at said inwardly facing edge surfaces allowing water to be maintained in said groove as said extensions support said belt on said inwardly facing edge surfaces limiting flow of water outwardly between said extensions and said belt.

2. A stone cutter comprising:

a vehicle movably mounted atop ground;

a main frame;

a jib movably mounted to said frame, said jib having a groove surface defining a groove and including water outlet means opening in said groove, said jib including a pair of spaced apart extensions on opposite sides of said groove extending the length of said groove;

a pair of spaced apart and aligned sheaves being rotatably mounted and with at least one of said sheaves having lateral width and being mounted to said jib;

means on said frame and operably associated with said sheaves being operable to rotate same;

a flexible belt extending through said groove with a top and opposite sides and extending around and in driven engagement by said sheaves, said sides defining the width of said belt which is sized at least equal to said lateral width allowing said one sheave to pass through a slot cut by said belt as said jib moves said belt through said slot, said belt having a continuous bottom projection facing inwardly into said groove being spaced from said groove surface along the length of said groove by water flowing outwardly from said water outlet means, said groove is complementary in shape to said projection positioned therein, said belt further having a pair of inwardly facing edge surfaces spaced apart by said projection; and, water means on said jib and in communication with said water outlet means and being operable to emit water between said groove and said projection on said belt to provide lubrication therebetween, said extensions forming limit means mounted on said jib and extending adjacent said belt at said inwardly facing edge surfaces allowing water to be maintained in said groove as said extensions support said belt on said inwardly facing edge surfaces limiting flow of water outwardly between said extensions and said belt.

3. The device of claim 2 wherein:

said belt includes multiple loops of cable extending through the length thereof.

4. The device of claim 3 wherein:

said belt is of a resilient material with said cable extending through said resilient material.

5. The device of claim 4 wherein:

said belt is shaped such that said opposite sides are perpendicular to said top, said belt having a bottom surface with a bottom truncated V-shaped projection extending along the length thereof, said projection drivingly engaged by complementary channels in the outer circumference of said sheaves.

* * * * *